United States Patent [19]

Ajiki et al.

[11] Patent Number: 4,787,346

[45] Date of Patent: Nov. 29, 1988

[54] VALVE OPERATING APPARATUS FOR AN INTERNAL COMBUSTION ENGINE

[75] Inventors: Yoshio Ajiki; Atsushi Ishida, both of Saitama, Japan

[73] Assignee: Honda Giken Kogyo Kabushiki Kaisha, Tokyo, Japan

[21] Appl. No.: 107,345

[22] Filed: Oct. 13, 1987

[30] Foreign Application Priority Data

Oct. 13, 1986 [JP] Japan ..... 61-242679

[51] Int. Cl.[4] ..... F01L 1/18; F01L 1/34; F01L 1/26

[52] U.S. Cl. ..... 123/90.44; 123/90.16; 123/90.39

[58] Field of Search ..... 123/90.16, 90.17, 90.39, 123/90.41, 90.44, 90.48

[56] References Cited

U.S. PATENT DOCUMENTS 2,829,540 4/1958 Niemeyer ..... 123/90.44 X
4,537,165 8/1985 Honda et al. ..... 123/90.16
4,567,861 2/1986 Hara et al. ..... 123/90.44 X
4,615,307 10/1986 Kodama et al. ..... 123/90.44 X
4,656,977 4/1987 Nagahiro et al. ..... 123/90.44 X

FOREIGN PATENT DOCUMENTS 0213758 3/1987 European Pat. Off. .
1003568 3/1952 France ..... 123/90.41
2185784 7/1987 United Kingdom .

*Primary Examiner*—Willis R. Wolfe
*Attorney, Agent, or Firm*—Lyon & Lyon

[57] ABSTRACT

Apparatus for maintaining the cam follower for operating a valve for an internal combustion engine in biased engagement against the cam includes a first spring operative to bias the cam follower under a low speed engine operating condition and a second spring series-connected to the first spring and having a spring constant greater than that of the first spring operative to bias the cam follower under a high speed engine operating condition.

8 Claims, 1 Drawing Sheet

VALVE OPERATING APPARATUS FOR AN INTERNAL COMBUSTION ENGINE

BACKGROUND OF THE INVENTION

The present invention relates to valve operating apparatus for an internal combustion engine. More particularly, the invention involves valve operating apparatus of the type including a camshaft rotatably driven by the engine, a plurality of cams on the camshaft for operating the intake or exhaust valves according to a selected mode of operation, and pivotably mounted rocker arms or cam followers for opening and closing the valves in response to rotation of the cams.

In valve operating devices of the type described, driver cam followers, operably connected to the valve or valves to be operated, and free cam followers, independent of the valves, are disposed adjacent each other and are operable in different modes by rotation of the cams. A selective coupling carried by the cam followers is actuable for selectively interconnecting or disconnecting the respective cam followers according to the desired mode of valve operation. Resilient biasing means are employed for urging the free cam follower toward its associated cam.

In prior art valve operating devices of this type, the resilient biasing means comprises a single spring disposed between the free cam follower and the engine body for resiliently urging the free cam follower toward the camshaft. Such a device is disclosed in Japanese Laid-Open Patent Publication No. 61-19911.

When the cam followers in such apparatus are to be interconnected by the selective coupling, it is preferable for the spring to have a low set load in order to allow the free cam follower to swing slightly so that the cam followers can be interconnected while permitting some dimensional tolerances. However, when the valve operating device operates at a high speed, it is desirable that the spring for lifting the free cam follower have a greater spring load than that required to accommodate dimensional tolerances. If the lifting load is produced by a single spring, the spring constant of the spring would, of necessity, be quite large, making it difficult to reduce the set load of the spring to accommodate dimensional tolerances. Consequently, where components of the valve operation device have manufacturing tolerances, and the space for accommodating the spring has a greater length in the direction in which the spring exerts resilient forces than the free length of the spring, the free cam follower cannot properly be held in position by the spring, thereby resulting in functional problems associated with the selective connection and disconnection of the cam followers.

It is to the amelioration of this problem, therefore, that the present invention is directed.

SUMMARY OF THE INVENTION

According to the present invention, the resilient biasing means employed in such apparatus comprises an abutment member abutting against the free cam follower, and a spring arrangement including a first spring of a relatively small spring constant and a second spring of a relatively large spring constant disposed in series between the abutment member and the engine body.

When such a spring arrangement is employed with cam followers connected by a selective coupling, the free cam follower can be slightly swung while compressing the first spring, thus allowing smooth switching of the selective coupling. When the free cam follower is depressed upon rotation of a camshaft, however, the free cam follower is strongly pressed against the camshaft under the bias of the second spring to meet high-speed rotation.

It is, accordingly, an object of the present invention to provide a valve operating device for an internal combustion engine capable of high-speed operation and allowing smooth switching operation of a selective coupling.

For a better understanding of the invention, its operating advangates and the specific objectives obtained by its use, reference should be made to the accompanying drawings and description which relate to a preferred embodiment thereof.

DESCRIPTION OF A PREFERRED EMBODIMENT OF THE INVENTION

Figure 1:
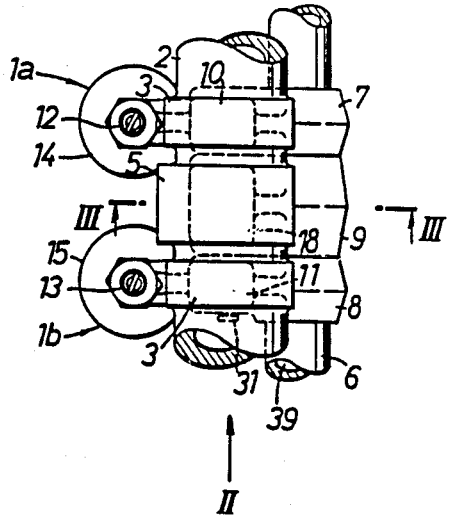
FIG. 1 is a plan view of the valve operating device according to the present invention.
Figure 2:
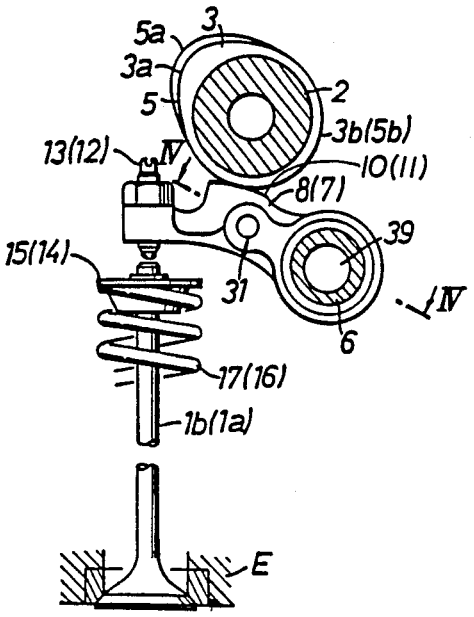
FIG. 2 is an elevational view taken in the direction of the arrow II in FIG. 1.

In FIGS. 1 and 2 a pair of intake valves 1*a*, 1*b* disposed in an engine body E are opened and closed by low-speed cams 3, 3 and a high-speed cam 5 integrally formed on a camshaft 2. The camshaft 2 is rotatable in synchronism with rotation of the engine at a speed ratio of ½ with respect to the speed of rotation of the engine. First and second driver rocker arms 7, 8 are angularly movably supported as driver cam followers on a rocker shaft 6 parallel to the camshaft 2 and a free rocker arm 9 is angularly movably supported as a free cam follower on the rocker shaft 6 intermediate the driver rocker arms 7, 8. A selective coupling 31 is disposed between the rocker arms 7 through 9.

The camshaft 2 is rotatably disposed above the engine body E. The low-speed cams 3, 3 are integrally formed on the camshaft 2 in alignment with the respective intake valves 1*a*, 1*b*. The high-speed cam 5 is integrally formed on the camshaft 2 in alignment with an intermediate position between the intake valves 1*a*, 1*b*. Each of the low-speed cams 3 has a profile corresponding to low-speed operation of the engine and includes a cam lobe 3*a* projecting radially outwardly a relatively small extent from a base circle 3*b*. The high-speed cam 5 has a profile corresponding to high-speed operation of the engine and includes a cam lobe 5*a* projecting radially outwardly from a base circle 5*b* to an extent greater than that of the cam lobe 3*a*. The cam lobe 5*a* also has a greater angular extent than that of the cam lobe 3*a*.

The rocker shaft 6 is fixed below the camshaft 2. The first and second driver rocker arms 7, 8 and the free rocker arm 9 are pivotally supported on the rocker shaft 6 in mutually adjacent relation to each other. The first and second driver rocker arms 7, 8 are basically of the same configuration. More specifically, the first and second driver rocker arms 7, 8 have base portions swingably supporte on the rocker shaft 6 in alignment with the intake valves 1*a*, 1*b* and extend to positions above the respective intake valves 1*a*, 1*b*. The first driver rocker arm 7 has on its upper portion a cam slipper 10 held in sliding contact with the low-speed cam 3, and the second driver rocker arm 8 has on its upper portion a cam slipper 11 held in sliding contact with the low-speed cam 3. Tappet screws 12, 13 are threaded through the ends of the first and second driver rocker arms 7, 8 positioned above the respective intake valves 1*a*, 1*b*, and are engageable respectively with the upper ends of the intake valves 1*a*, 1*b*.

Flanges 14, 15 are attached to the upper ends of the respective intake valves 1*a*, 1*b*. The intake valves 1*a*, 1*b* are normally urged in a closing direction, i.e., upwardly, by valve springs 16, 17 disposed between the flanges 14, 15 and the engine body E.

Figure 3:
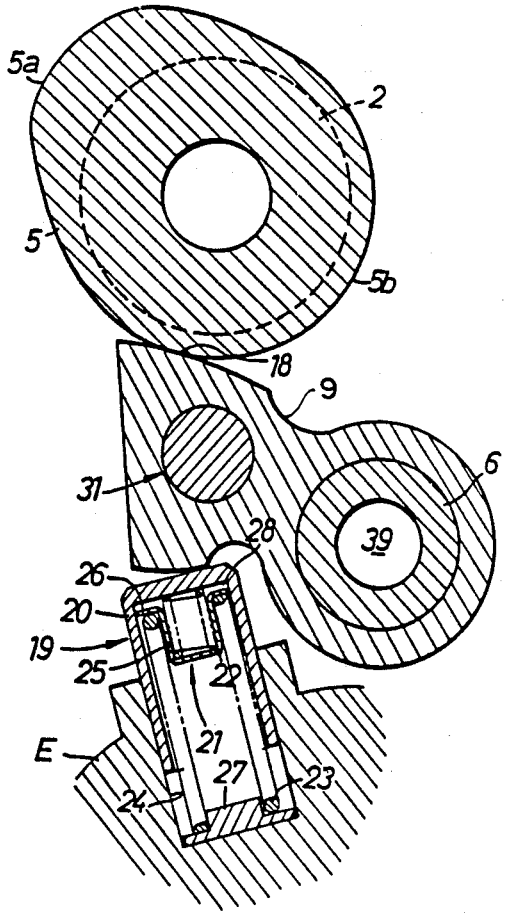
FIG. 3 is an enlarged sectional view taken along line III—III of FIG. 1.

As best shown in FIG. 3, the free rocker arm 9 is pivotally supported on the rocker shaft 6 between the first and second driver rocker arms 7, 8. The free rocker arm 9 extends slightly from the rocker arm 6 toward the intake valves 1*a*, 1*b*, and has on its upper portion a cam slipper 18 held in sliding contact with the high-speed cam 5. The free rocker arm 9 is resiliently urged into sliding contact with the high-speed cam 5 by a resilient biasing assembly 19 disposed between the free rocker arm 9 and the engine body E.

The resilient biasing assembly 19 comprises a cylindrical abutment member 20 having a closed upper end abutting against the free rocker arm 9. A cap-shaped retainer 21 is movably disposed in the abutment member 20 and has an open end facing the closed end of the abutment member 20. A first spring 22 is disposed between the abutment member 20 and the retainer 21, and a second spring 23 is disposed between the retainer 21 and the engine body E.

The engine body E has a cylindrical bore 24 disposed in a position subjacent to the free rocker arm 9 and opening upwardly. The abutment member 20 is slidably fitted in the bore 24 with the open end of the abutment member 20 being directed toward the bottom of the bore.

The retainer 21 includes a smaller-diameter, closed ended cylindrical portion 25 having an open end directed toward the closed end of the abutment member 20. An annular seating flange 26 extends around the entire edge of the open end of the retainer 21. The first spring 22 is interposed between the closed end of the abutment member 20 and the closed end of the cylindrical portion 25 of the retainer 21. The first spring 22 has a relatively small set load. A seat member 27 is disposed on the bottom of the bore 24. The second spring 23 is interposed between the seat member 27 and the seat flange 26 of the retainer 21. The set load of the second spring 23 is selected to be greater than the set load of the first spring 22. The axial dimensions of the springs 22 and 23 are such that when the free rocker arm 9 is held in sliding contact with the base circle 5*b* of the high-speed cam 5, the second spring 23 is in its free state, leaving a gap 28 between the retainer 21 and the abutment member 20.

Figure 4:
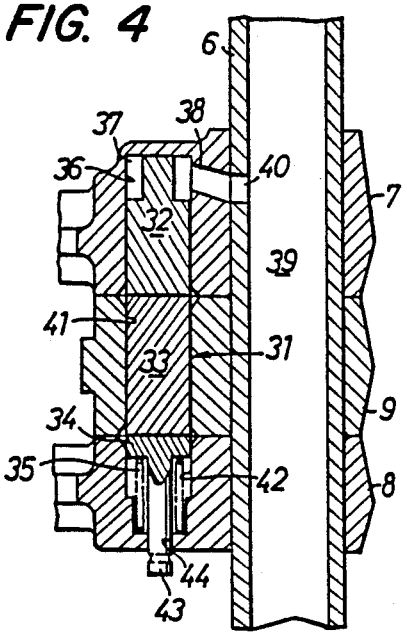
FIG. 4 is an enlarged sectional view taken along line IV—IV of FIG. 2.

As illustrated in FIG. 4, the first driver rocker arm 7 and the free rocker arm 9 are held in sliding contact with each other, and the free rocker arm 9 and the second driver rocker arm 8 are held in sliding contact with each other. A selective coupling 31 is operatively disposed between the rocker arms 7 through 9. The selective coupling 31 comprises a first coupling pin 32 capable of interconnecting the first driver rocker arm 7 and the free rocker arm 9, a second coupling pin 33 capable of interconnecting the free rocker arm 9 and the second driver rocker arm 8 and held coaxially against the first coupling pin 32, a stopper 34 for limiting movement of the coupling pins 32, 33, and a return spring 35 for urging the coupling pins 32, 33 and the stopper 34 in a direction to disconnect the rocker arms. The first driver rocker arm 7 has a first guide hole 36 defined therein parallel to the rocker shaft 6 and opening toward the free rocker arm 9. The first coupling pin 32 is slidably fitted in the first guide hole 36. A hydraulic pressure chamber 37 is defined between the closed end of the first guide hole 36 and the first coupling pin 32. The first driver rocker arm 7 has a hydraulic passage 38 defined therein in communication with the hydraulic pressure chamber 37. The rocker shaft 6 has a hydraulic passage 39 coupled to a source of hydraulic pressure (not shown). The hydraulic passages 38, 39 are held in communication with each other through a hole 40 defined in a side wall of the rocker shaft 6, irrespective of the extent to which the first driver rocker arm 7 is angularly moved about the rocker shaft 6.

The free rocker arm 9 has a guide hole 41 extending between its opposite surfaces for registration with the first guide hole 36. The second coupling pin 33, having a length equal to the entire length of the guide hole 41, is slidably fitted therein. The second coupling pin 33 has an outside diameter equal to the outside diameter of the first coupling pin 32.

The second driver rocker arm 8 has a second guide hole 42 defined therein for registration with the guide hole 41. The second guide hole 42 opens toward the free rocker arm 9 and extends parallel to the rocker shaft 6. The circular stopper 34 is slidably fitted in the second guide hole 42 and held against the second coupling pin 33. A shaft 43 is coaxially joined to the stopper 34 and extends through a guide hole 44 defined in the second driver rocker arm 8 at the closed end of the second guide hole 42. The return spring 35 is disposed around the shaft 43 between the stopper 34 and the closed end of the second guide hole 42. The stopper 34, the second coupling pin 33, and the first coupling pin 32 are thereby urged by the return spring 35 into the position in which the rocker arms are mutually disconnected.

Operation of the described aparatus is as follows. During low-speed operation of the engine, no hydraulic pressure is supplied to the hydraulic pressure chamber 37. Therefore, the first and second coupling pins 32, 33 and the stopper 34 are moved a maximum stroke toward the hydraulic pressure chamber 37 by the return spring 35. In this condition, the abutting surfaces of the first and second coupling pins 32, 33 are positioned in alignment with the slidingly contacting lateral surfaces of the first driver rocker arm 7 and the free rocker arm 9, and the abutting surfaces of the second coupling pin 33 and the stopper 34 are positioned in alignment with the slidingly contacting surfaces of the free rocker arm 9 and the second driver rocker arm 8. Therefore, the first driver rocker arm 7, the free rocker arm 9, and the second driver rocker arm 8 are held in mutually sliding contact, and the first and second coupling pins 32, 33 and the second coupling pin 33 and the stopper 34 are also held in mutually sliding contact. In this condition the rocker arms 7 through 9 can be angularly displaced with respect to each other.

With the rocker arms 7 through 9 being thus disconnected by the selective coupling 31, the first and second driver rocker arms 7, 8 are angularly moved in sliding contact with the lowspeed cams 3, 3 in response to rotation of the camshaft 2, and the intake valves 1*a*, 1*b* are opened and closed at the timing and lift according to the profile of the low-speed cams 3, 3. At this time, the free rocker arm 9 is angularly moved in sliding contact with the high-speed cam 5, but such angular movement does not affect operation of the intake valves 1*a*, 1*b* in any way.

When the engine is to operate in a high-speed range, working oil pressure is supplied to the hydraulic pressure chamber 37. The first coupling pin 32 is moved axially and pushes the second coupling pin 33 and the stopper 34 against the spring force of the return spring 35. Such movement is effected when the first and second driver rocker arms 7, 8 slidingly contact the base circles 3*b* of the low-speed cams 3 and the free rocker arm 9 slidingly contacts the base circle 5*b* of the high-speed cam 5, so that the first guide hole 36, the guide hole 41, and the second guide hole 42 are axially aligned. The first coupling pin 32 is thereby caused to extend into the guide hole 41, and the second coupling pin 32 is caused to extend into the second guide hole 42.

In practice, the first and second guide holes 36, 42 and the guide hole 41 may not be fully axially aligned due to manufacturing tolerances of the rocker arms 7 through 9. When the free rocker arm 9 slidingly contacts the base circle 5*b* of the high-speed cam 5, the second spring 23 of the resilient biasing assembly 19 is in its free state with the gap 28 between the abutment member 20 and the retainer 21. Therefore, it is possible to angularly move the free rocker arm 9 slightly while compressing the first spring 22 with its set load being relatively small. The axes of the holes 36, 42, 41 can be brought into alignment by slightly pushing the free rocker arm 9 upwardly or downwardly with the distal end of the first coupling pin 32.

With the first coupling pin 32 displaced into the guide hole 41 and the second coupling pin 33 displaced into the second guide hole 42, the first driver rocker arm 7, the free rocker arm 9, and the second driver rocker arm 8 are interconnected. Therefore, since the amount of angular movement of the free rocker arm 9 in sliding contact with the high-speed cam 5 is greatest, the first and second driver rocker arms 7, 8 are caused to swing with the free rocker arm 9, and, hence, the intake valves 1*a*, 1*b* are opened and closed at the timing and lift according to the cam profile of the high-speed cam 5.

Because during high-speed operation of the engine, the intake valves 1*a*, 1*b* are opened and closed by the free rocker arm 9, the cam slipper 18 of the free rocker arm 9 is required to be held reliably in sliding contact with the high-speed cam 5, and the resilient biasing assembly 19 needs to press the free rocker arm 9 against the cam 5 under a relatively strong spring force. When the cam lobe 5*a* of the high-speed cam 5 slidingly contacts the cam slipper 18, the first spring 22 with its set load being relatively small is compressed until the abutment member 20 engages the retainer 21 and the abutment member 20 is urged toward the high-speed cam 5 by the second spring 23 with its set load being relatively great. Consequently, the free rocker arm 9 is held in sliding contact with the high-speed cam 5 under a relatively great spring force, so that a high lifting load can be obtained.

Therefore, by means of the present invention, a resilient biasing means is provided that has a relatively weak spring force for allowing a selective coupling to perform its switching operation reliably and a relatively strong spring force which meets the requirements for high-speed operation.

While the present invention has been described herein in relation to intake valves it should be understood that the present invention is equally applicable to exhaust valves. Moreover, it should be futher understood that, although a preferred embodiment of the invention has been illustrated and described herein, changes and modifications can be made in the described arrangement without departing from the scope of the appended claims.

We claim:

1. Operating apparatus for an valve for an internal combustion engine including a camshaft rotatably driven by said engine, a cam on said camshaft and a cam follower operably interconnecting said cam and said valve and means for biasing said cam follower against said cam, said means comprising:

a stationary base subjacent said cam follower;

an abutment member movable in a direction between said base and said cam follower, spring means extending between said base and said abutment member for biasing said abutment member against said cam follower including a first spring of relatively small spring constant and a second spring of relatively large spring constant series-connected to said first spring.

2. The valve operating apparatus according to claim 1 in which said stationary base comprises a bore in said engine and said abutment member is slidable in said bore.

3. The valve operating apparatus according to claim 2 in which said abutment member is a hollow cylindrical member having a closed end engaging said cam follower and an open end receiving said spring means.

4. The valve operating apparatus according to claim 3 in which said second spring is a coil spring having one end operatively engaging the base of said bore, a retainer mounted in the other end of said second spring, and said first spring having one end mounted in said retainer and its other end biasing said abutment member in spaced relation from said other end of said second spring.

5. For use in an internal combustion engine having a cylinder, a valve operative with said cylinder, a driver cam follower driven by a first rotatable cam for operating said valve under a first engine operating condition, a free cam follower driven by a second rotatable cam and selectively couplable with said first cam follower for operating said valve under a second engine operating condition, and means for biasing said free cam follower against said second cam comprising:

a stationary base subjacent said free cam follower;

an abutment member movable in a direction between said base and said free cam follower; and spring means extending between said base and said abutment member for biasing said abutment member against said free cam follower including a first spring having a relatively low spring constant for biasing said abutment member against said free cam follower when said free cam follower is uncoupled from said driver cam follower, and a second spring series-connected to said first spring, said second spring having a spring constant greater than that of said first spring for biasing said abutment member against said free cam follower when said free cam follower is coupled to said driver cam follower.

6. The valve operating apparatus according to claim 5 in which said stationary base comprises a bore in said engine and said abutment member is slidable in said bore.

7. The valve operating apparatus according to claim 6 in which said abutment member is a hollow cylindrical member having a closed end engaging said free cam follower and an open end receiving said spring means.

8. The valve operating apparatus according to claim 7 in which said second spring is a coil spring having one end operatively engaging the base of said bore, a retainer mounted in the other end of said second spring, and said first spring having one end mounted in said retainer and its other end biasing said abutment member in spaced relation from said other end of said second spring.

* * * * *